US011497371B2

(12) United States Patent
Davila et al.

(10) Patent No.: US 11,497,371 B2
(45) Date of Patent: Nov. 15, 2022

(54) FLOOR CLEANER

(71) Applicant: TECHTRONIC CORDLESS GP, Anderson, SC (US)

(72) Inventors: Rafael Davila, Kannapolis, NC (US); Robert Lightbourn, Charlotte, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 153 days.

(21) Appl. No.: 17/124,865

(22) Filed: Dec. 17, 2020

(65) Prior Publication Data

US 2021/0186292 A1 Jun. 24, 2021

Related U.S. Application Data

(60) Provisional application No. 62/950,649, filed on Dec. 19, 2019.

(51) Int. Cl.
*A47L 11/40* (2006.01)
*A47L 11/30* (2006.01)

(52) U.S. Cl.
CPC ..... *A47L 11/4027* (2013.01); *A47L 11/30* (2013.01); *A47L 11/4016* (2013.01); *A47L 11/4088* (2013.01)

(58) Field of Classification Search
CPC ..... A47L 11/4027; A47L 11/30; A47L 11/4016; A47L 11/4088; A47L 11/4019; A47L 11/4025
See application file for complete search history.

(56) References Cited

U.S. PATENT DOCUMENTS

| | | | |
|---|---|---|---|
| 5,850,668 | A | 12/1998 | Berfield et al. |
| 5,918,344 | A | 7/1999 | Crevling, Jr. et al. |
| 5,920,955 | A | 7/1999 | Berfield |
| 5,931,991 | A | 8/1999 | Leon |
| 5,954,863 | A | 9/1999 | Loveless et al. |
| 5,966,775 | A | 10/1999 | Berfield |
| 6,009,596 | A | 1/2000 | Buss et al. |
| 6,049,940 | A | 4/2000 | Robitaille |
| 6,069,330 | A | 5/2000 | Crevling, Jr. et al. |
| 6,347,430 | B1 | 2/2002 | Buss et al. |
| 6,534,003 | B1 | 3/2003 | Nguyen |
| 6,629,332 | B2 | 10/2003 | Morgan et al. |
| 6,687,952 | B1 | 2/2004 | Mohan, Jr. |
| 6,767,380 | B2 | 7/2004 | von Stackelberg, Jr. |
| 6,912,757 | B2 | 7/2005 | Kaufman et al. |

(Continued)

FOREIGN PATENT DOCUMENTS

| | | | |
|---|---|---|---|
| CN | 202458223 | U | 10/2012 |
| CN | 103190868 | A | 7/2013 |

(Continued)

OTHER PUBLICATIONS

International Search Report and Written Opinion for Application No. PCT/US2020/065534 dated Mar. 29, 2021 (13 pages).

*Primary Examiner* — David Redding
(74) *Attorney, Agent, or Firm* — Michael Best & Friedrich LLP

(57) ABSTRACT

A floor cleaner including a vacuum source, a supply tank, and a recovery tank. The floor cleaner is configured to remove debris and fluid from a surface to be cleaned. The recovery tank includes a removably coupleable strainer configured to filter hair and large debris from a dirty fluid during emptying of the recovery tank.

15 Claims, 10 Drawing Sheets

(56) References Cited

U.S. PATENT DOCUMENTS

| | | | |
|---|---|---|---|
| 7,254,864 | B2 | 8/2007 | Cipolla et al. |
| 7,287,301 | B2 | 10/2007 | Marshall et al. |
| 7,322,071 | B2 | 1/2008 | Lee et al. |
| 7,377,009 | B2 | 5/2008 | Lee et al. |
| 7,526,833 | B2 | 5/2009 | Cochran et al. |
| 7,653,963 | B2 | 2/2010 | Cochran et al. |
| 7,685,671 | B2 | 3/2010 | Jansen |
| 7,725,984 | B2 | 6/2010 | Jansen |
| 7,767,030 | B2 | 8/2010 | Addicks et al. |
| 7,797,792 | B2 | 9/2010 | Cipolla et al. |
| 7,836,544 | B2 | 11/2010 | Jansen |
| 7,870,638 | B2 | 1/2011 | Jansen |
| D633,668 | S | 3/2011 | Griffin et al. |
| 8,074,321 | B2 | 12/2011 | Fry et al. |
| 8,117,713 | B2 | 2/2012 | Kasper et al. |
| 8,250,703 | B2 | 8/2012 | Marshall et al. |
| 8,365,350 | B2 | 2/2013 | Cochran et al. |
| 9,295,365 | B2 | 3/2016 | Huffman et al. |
| 2002/0108204 | A1 | 8/2002 | Buss et al. |
| 2005/0273969 | A1 | 12/2005 | Watson et al. |
| 2006/0169146 | A1 | 8/2006 | Cho |
| 2006/0254020 | A1 | 11/2006 | Robinson et al. |
| 2007/0209342 | A1 | 9/2007 | Cho |
| 2007/0294858 | A1 | 12/2007 | Murphy |
| 2009/0260177 | A1 | 10/2009 | Richards |
| 2011/0318196 | A1 | 12/2011 | Alberts, III et al. |
| 2014/0259514 | A1 | 9/2014 | Vail et al. |
| 2015/0173575 | A1 | 6/2015 | Kerr |
| 2016/0331201 | A1 | 11/2016 | Goff |
| 2019/0159646 | A1 | 5/2019 | Luyckx et al. |

FOREIGN PATENT DOCUMENTS

| | | | |
|---|---|---|---|
| CN | 204274310 | U | 4/2015 |
| CN | 204722984 | U | 10/2015 |
| CN | 204862989 | U | 12/2015 |
| CN | 105534423 | A | 5/2016 |
| CN | 105662289 | A | 6/2016 |
| CN | 106235970 | A | 12/2016 |
| CN | 206044552 | U | 3/2017 |
| DE | 10049098 | C1 | 9/2002 |
| DE | 20205565 | U1 | 8/2003 |
| EP | 2359729 | A2 | 8/2011 |
| EP | 3491991 | A1 | 6/2019 |
| FR | 2844697 | A1 | 3/2004 |
| WO | 0108543 | A1 | 2/2001 |
| WO | 2009131445 | A1 | 10/2009 |
| WO | 2014032945 | A1 | 3/2014 |

FLOOR CLEANER

CROSS-REFERENCE TO RELATED APPLICATIONS

This application claims priority to U.S. Provisional Patent Application No. 62/950,649, filed Dec. 19, 2019, the entire contents of which are hereby incorporated by reference herein.

BACKGROUND

The present invention relates to floor cleaners.

SUMMARY

In another embodiment the invention provides a floor cleaner including a vacuum source, a supply tank configured to store a cleaning fluid, a distribution nozzle in fluid communication with the supply tank, the distribution nozzle configured to dispense the cleaning fluid onto a surface to be cleaned, a suction inlet in fluid communication with the vacuum source, and a recovery tank in fluid communication with the vacuum source and the suction inlet. The recovery tank is configured to store the cleaning fluid drawn through the suction inlet from the surface by the vacuum source. The recovery tank includes a tank body having a lower end wall, an open upper end, and a sidewall that extends upwardly from the lower end wall to the open upper end. The recovery tank also includes a cover assembly removably coupled to the open upper end, configured to close the open upper end in a coupled position, and uncover the open upper end in an uncoupled position. A strainer with a perforated body is positionable in the tank body in a seated position with the cover assembly in the uncoupled position. The cover assembly is coupleable to the open upper end when the strainer is removed from the tank body, and the cover assembly is not coupleable to the open upper end when the strainer is positioned inside the tank body. The perforated body of the strainer is disposed adjacent the sidewall when the strainer is in the seated position.

In another embodiment the invention provides a floor cleaner including a vacuum source, a supply tank configured to store a cleaning fluid, a distribution nozzle in fluid communication with the supply tank, the distribution nozzle configured to dispense the cleaning fluid onto a surface to be cleaned, a suction inlet in fluid communication with the vacuum source, and a recovery tank in fluid communication with the vacuum source and the suction inlet. The recovery tank is configured to store the cleaning fluid drawn through the suction inlet from the surface by the vacuum source. The recovery tank includes a tank body having a lower end wall, an open upper end, a sidewall that extends upwardly from the lower end wall to the open upper end, and an inlet duct that extends upwardly from the lower end wall. The recovery tank also includes a cover assembly removably coupled to the open upper end, configured to close the open upper end in a coupled position. A strainer with a perforated body is removably coupled to the inlet duct. The cover assembly can be coupled to the open upper end when the strainer is removed from the tank body, and the cover assembly cannot be coupled to the open upper end when the strainer is coupled to the tank body. The strainer is coupleable inside the tank body with the perforated body disposed adjacent the sidewall when the cover assembly is removed from the tank body.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
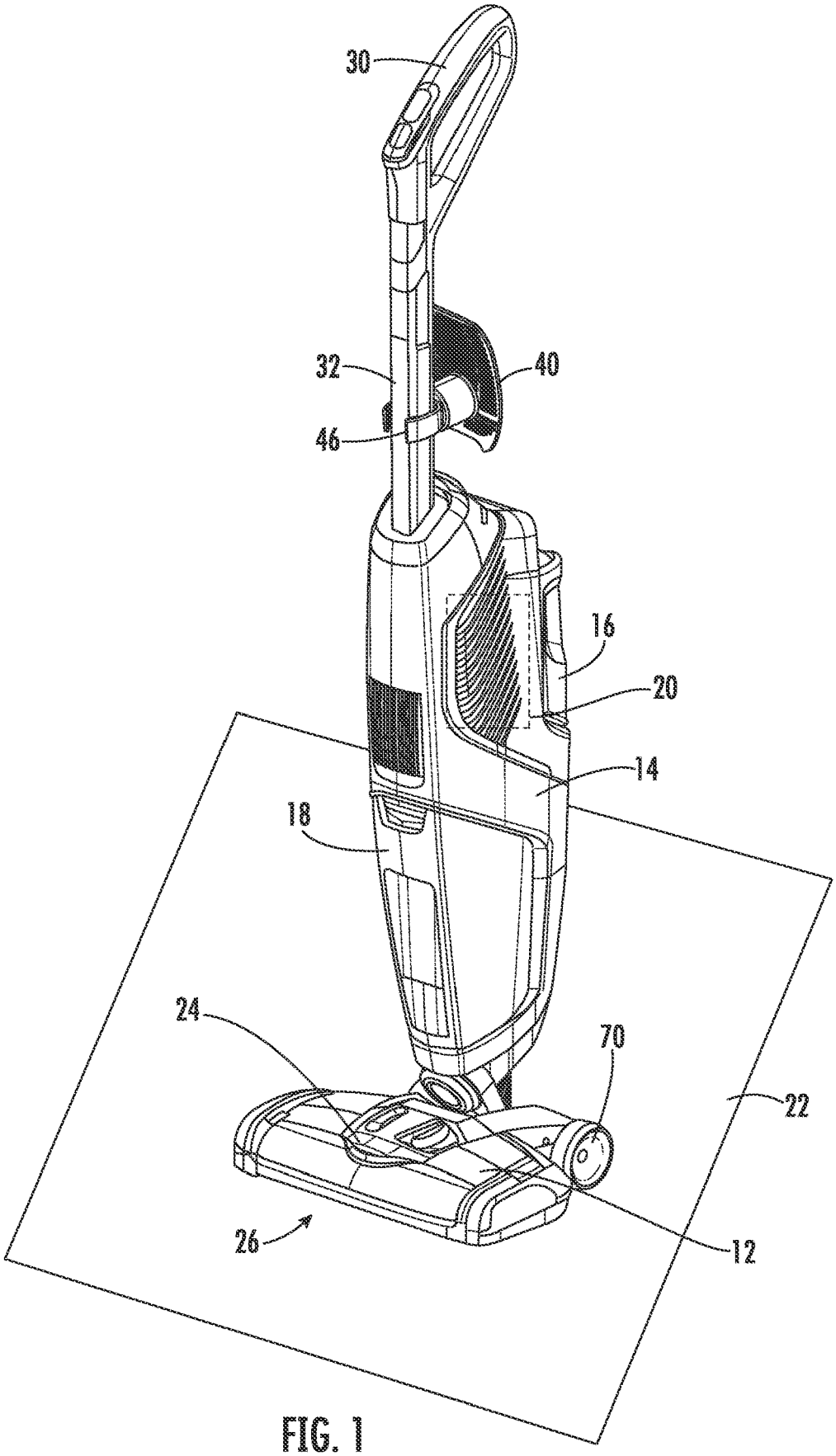
FIG. 1 is a perspective view of a floor cleaner according to one embodiment.
Figure 2:
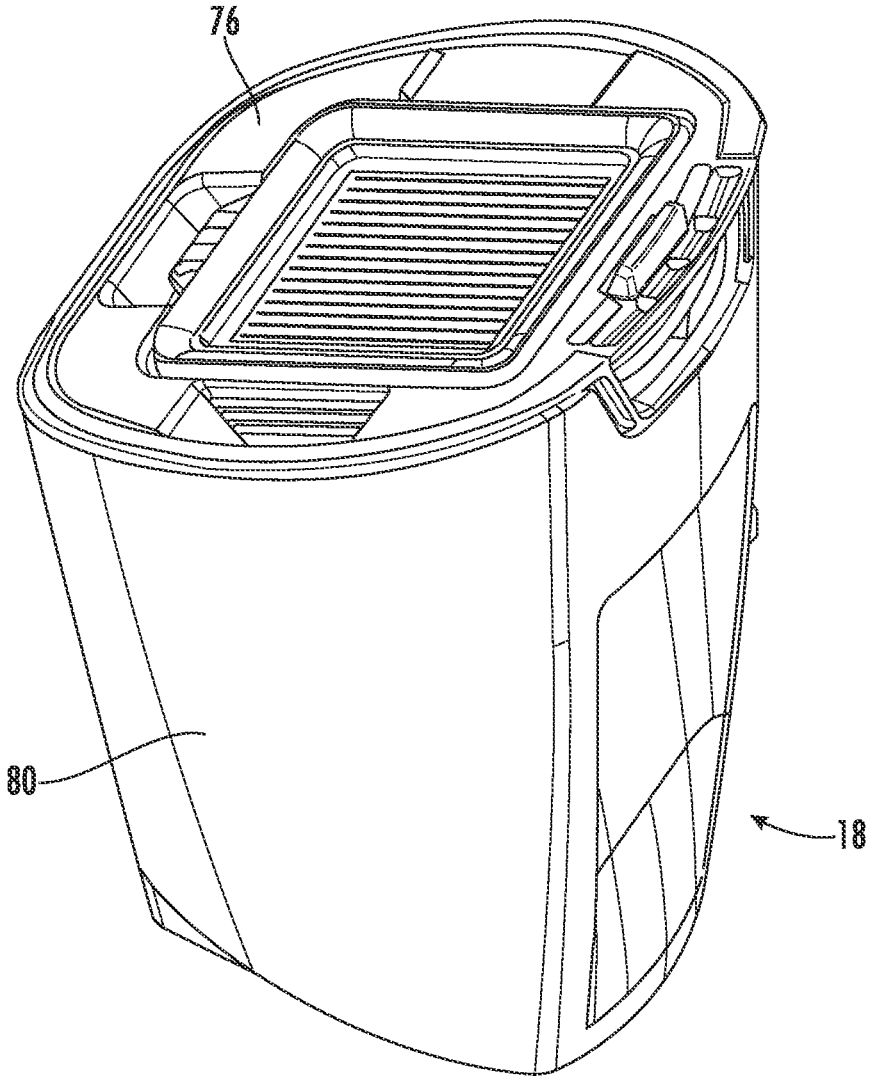
FIG. 2 is a perspective view of a recovery tank of the floor cleaner of FIG. 1 according to one embodiment.

FIG. 1 illustrates a floor cleaner 10. In the illustrated embodiment, the floor cleaner 10 includes a base 12 and a body 14 pivotally coupled to the base 12. The body 14 is pivotal relative the base 12 between an upright storage position (FIG. 1) and an inclined operating position. The floor cleaner 10 includes a handle assembly 30 with an extension 32 that extends from the body 14. The floor cleaner 10 further includes a supply tank 16, a distribution nozzle 24, a recovery tank 18, and a vacuum source 20. The supply tank 16 is configured to store a cleaning fluid and the floor cleaner 10 is operable to dispense the cleaning fluid onto a surface 22 to be cleaned through the distribution nozzle 24. The vacuum source 20 is operable to draw the cleaning fluid from the surface 22 into the recovery tank 18. In some embodiments, the supply tank and distribution nozzle are omitted and the floor cleaner 10 is configured to recover fluids from the surface 22, such as a wet/dry vacuum. The cleaner 10 further includes a strainer 40 to aid in emptying the recovery tank 18 after the cleaner is used.

The base 12 is movable over the surface 22 to be cleaned. In the illustrated embodiment, the base 12 includes wheels 70 to facilitate moving the base 12 over the surface 22 to be cleaned. The base 12 includes a suction inlet 26 in fluid communication with the vacuum source 20 and the recovery tank 18. The cleaning fluid is drawn from the surface 22 to be cleaned through the suction inlet 26 and into the recovery tank 18.

The recovery tank 18 includes a tank body 74, a cover assembly 76 coupled to the tank body 74, and a strainer 40 positionable in the tank body 74 when the cover assembly 76 is removed. The tank body 74 has a lower end wall 78 and a sidewall 80 that extends upwardly from the lower end wall 78 to an open upper end 82 of the tank body 74. The cover assembly 76 is removably coupled to the open upper end 82 of the tank body to close the open upper end 82 of the tank body in a coupled position, and removable from the upper end 82 to uncover the open upper end 82 in an uncoupled position. The cover assembly 76 is removable for emptying the tank body 74 when fluid or debris are deposited in the recovery tank 18. The strainer 40 is positionable in the tank body 74 in a seated position after the cover 76 is removed, such that the cover 76 is in the uncoupled position. The strainer 40 is disposed adjacent the sidewall 80 when the strainer 40 is in the seated position. With the strainer 40 placed in its seated position, fluid in the tank can be poured out through the strainer and the strainer configured to retain debris in the tank.

In the embodiments shown in FIGS. 3-10, the strainer 40 interferes with the cover assembly 76 when the strainer 40 is in its seated position preventing the cover 76 from being installed on the tank body 74. As such, the cover assembly 76 is configured to be coupled to the open upper end 82 when the strainer 40 is removed from the tank body 74, and the cover assembly 76 cannot be coupled to the open upper end 82 when the strainer 40 is coupled to the tank body 74. Said another way, the cover assembly 76 is removably coupled to the open upper end 82 of the tank body when the strainer 40 is removed from the tank body 74, and the cover assembly 76 is not fitable over the tank body 74 when the strainer 40 is positioned inside the tank body 74. When the cover assembly 76 is removed, the strainer 40 can be coupled to the tank body 74 before emptying the tank body 74.

The strainer 40 includes a perforated body 42 that is configured to catch debris, such as lint, hair and other debris, while allowing fluid and small debris to exit during emptying of the recovery tank 18. The size of the perforations are selected to control the size of debris that passes through the strainer 40 as desired for the application. When the recovery tank 18 is ready to be emptied, a user removes the recovery tank 18 from the body 14 and removes the cover assembly 76. The user then inserts the strainer 40 into the tank body 74. In the illustrated embodiment, the strainer 40 is coupled to the inlet duct 86. The user then inverts the recovery tank 18 and pours the dirty liquid through the strainer 40, wherein the strainer 40 catches and retains debris on a bottom side 44, while allowing liquid egress through the perforated body 42. Once the liquid is removed from the recovery tank 18, the user can then remove the strainer 40, and dispose of the collected debris. Thus, the strainer 40 is not filtering the cleaning fluid upon ingress, but rather upon removal and emptying by the user.

The tank body 74 includes an inlet aperture 84 and an inlet duct 86. The inlet duct 86 includes an outlet aperture 88 at an end of the duct 86 opposite the inlet aperture 84. In one embodiment, the lower end wall 78 supports the inlet duct 86. The inlet duct 86 extends vertically upwards from the lower end wall 78 and includes the inlet aperture 84 and the outlet aperture 88. As shown in FIGS. 5-10, the strainer 40 includes a fitting 45 to releasably couple the strainer 40 to the recovery tank 18 positioning the strainer 40 in a seated position. The illustrated fitting 45 is in the form of a collar that slides over the end of the inlet duct 86 in friction engagement with an outer portion of the inlet duct 86, releasably coupling the strainer 40 to the recovery tank 18. The fitting 45 may alternatively be releaseably coupled to the recovery tank 18 by snap-fit engagement, tongue and groove connection, latching arrangement, or any suitable connecting mechanism. In the illustrated embodiment, the strainer 40 covers the outlet aperture 88 in the seated position.

Figure 9:
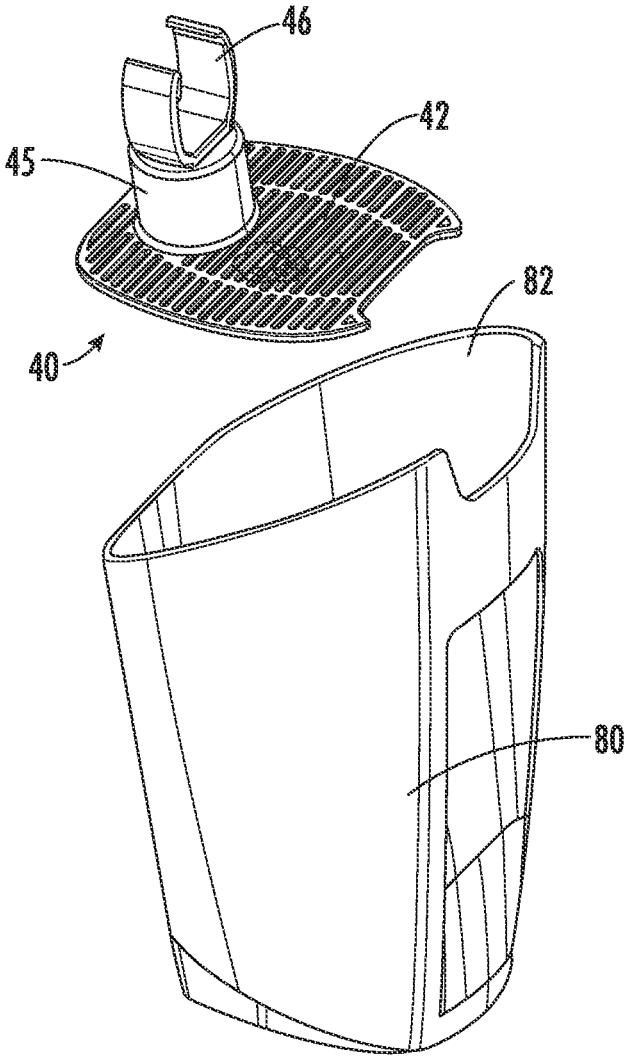
FIG. 9 is a perspective view of a recovery tank with another alternative strainer in a removed position.
Figure 10:
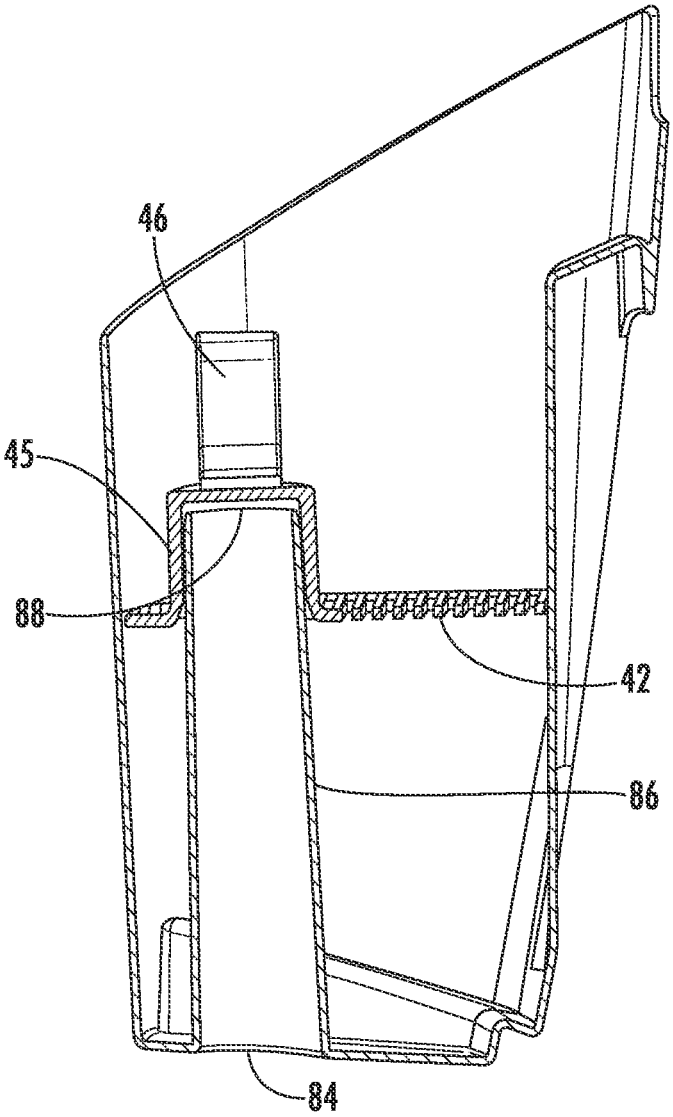
FIG. 10 is cross-sectional view of the recovery tank of FIG. 9 with the strainer in a seated position.

In the embodiment shown in FIGS. 9 and 10, the strainer 40 includes a connecting member 46 that is configured to be coupled to the extension 32 of the floor cleaner 10, under the handle assembly 30 when the strainer 40 is in a removed position (shown in FIG. 1). In another embodiment, the floor cleaner 10 includes the connecting member and is configured to couple a portion of the strainer 40 in a removed position. In one embodiment, the connecting member 46 of the strainer 40 is configured to couple a receiving member (not shown) on the floor cleaner 10 for storage when the strainer 40 is in the removed position. In the embodiment shown in FIGS. 5-8, the strainer 40 may include a graspable handle portion 48. The handle portion 48 is configured for the user to remove and insert the strainer 40.

The inlet aperture 84 is in fluid communication with the suction inlet 26 (FIG. 1), and the outlet aperture 88 opens facing upwards towards the upper end 82 of the tank body 74. Air and fluid enter the recovery tank 18 through the inlet aperture 84 of the inlet duct 86 and travel upwards through the outlet aperture 88. In the embodiment illustrated in FIG. 4, the air and fluid traveling through the outlet aperture 88 are directed to a baffle surface 43 to separate fluid from the air flow such that fluid accumulates in the recovery tank body 74. Air suctioned by the vacuum source 20 exits the recovery tank 18 by flowing through a suction air outlet 50 the cover 76.

Figure 3:
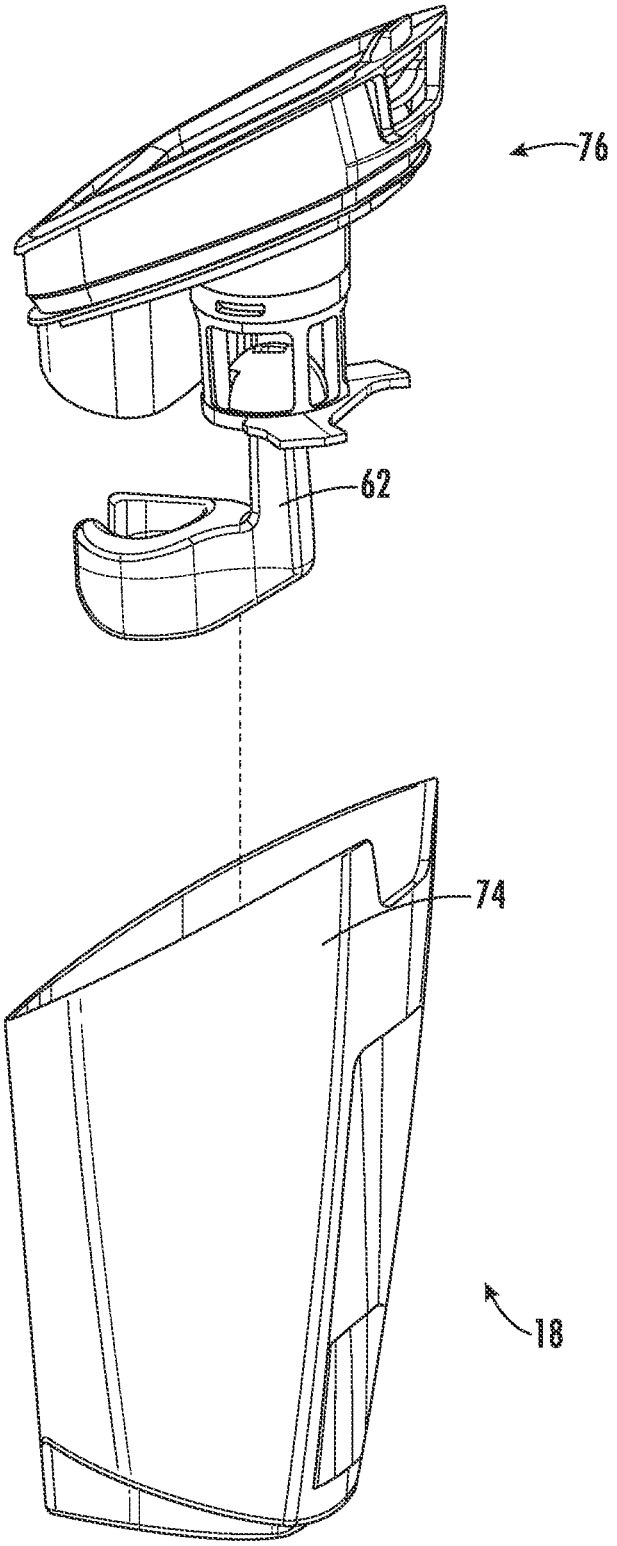
FIG. 3 is a perspective view of a recovery tank with a cover assembly in a removed position.
Figure 4:
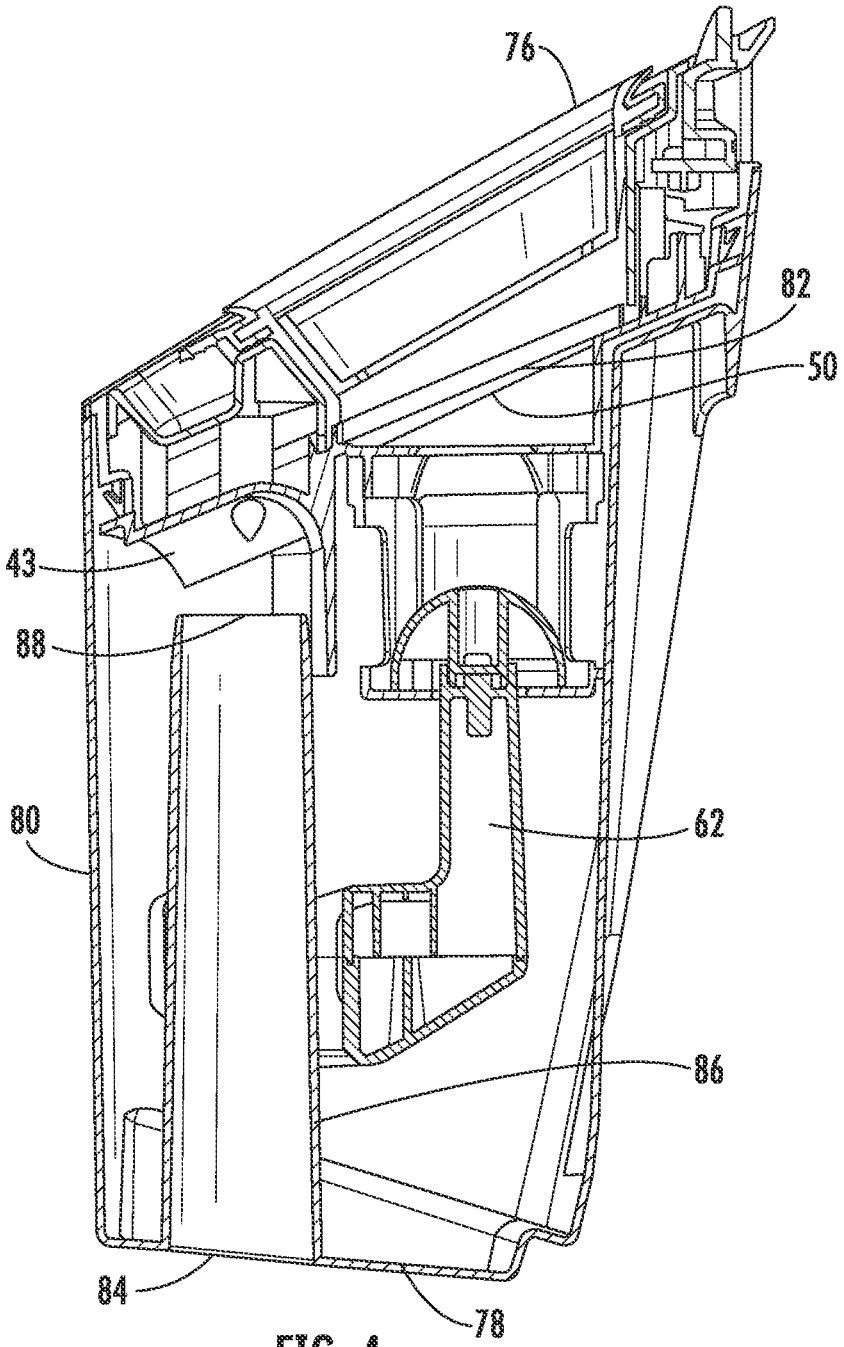
FIG. 4 is a cross-sectional view of the recovery tank of FIG. 2.
Figure 5:
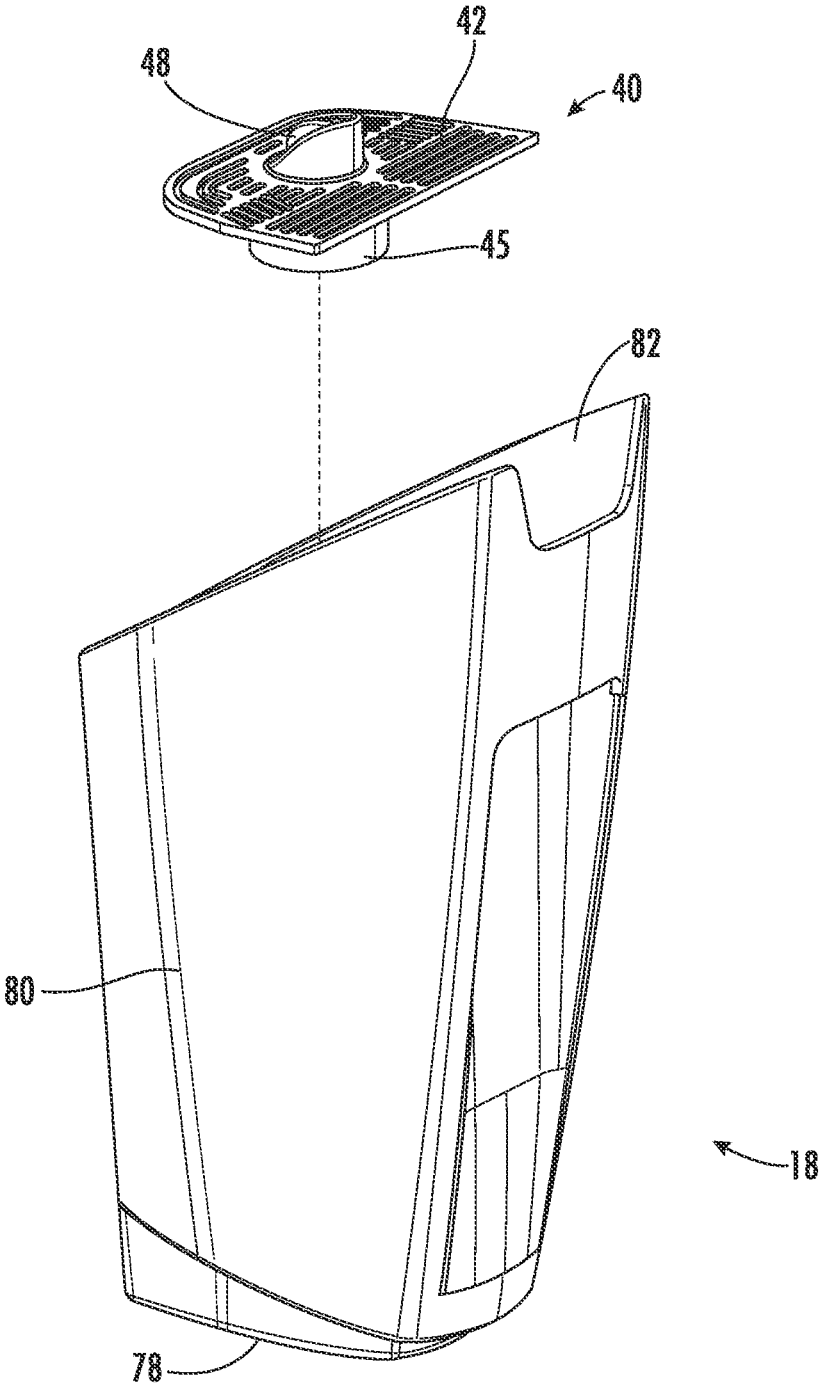
FIG. 5 is a perspective view of a recovery tank with a strainer in a removed position.
Figure 6:
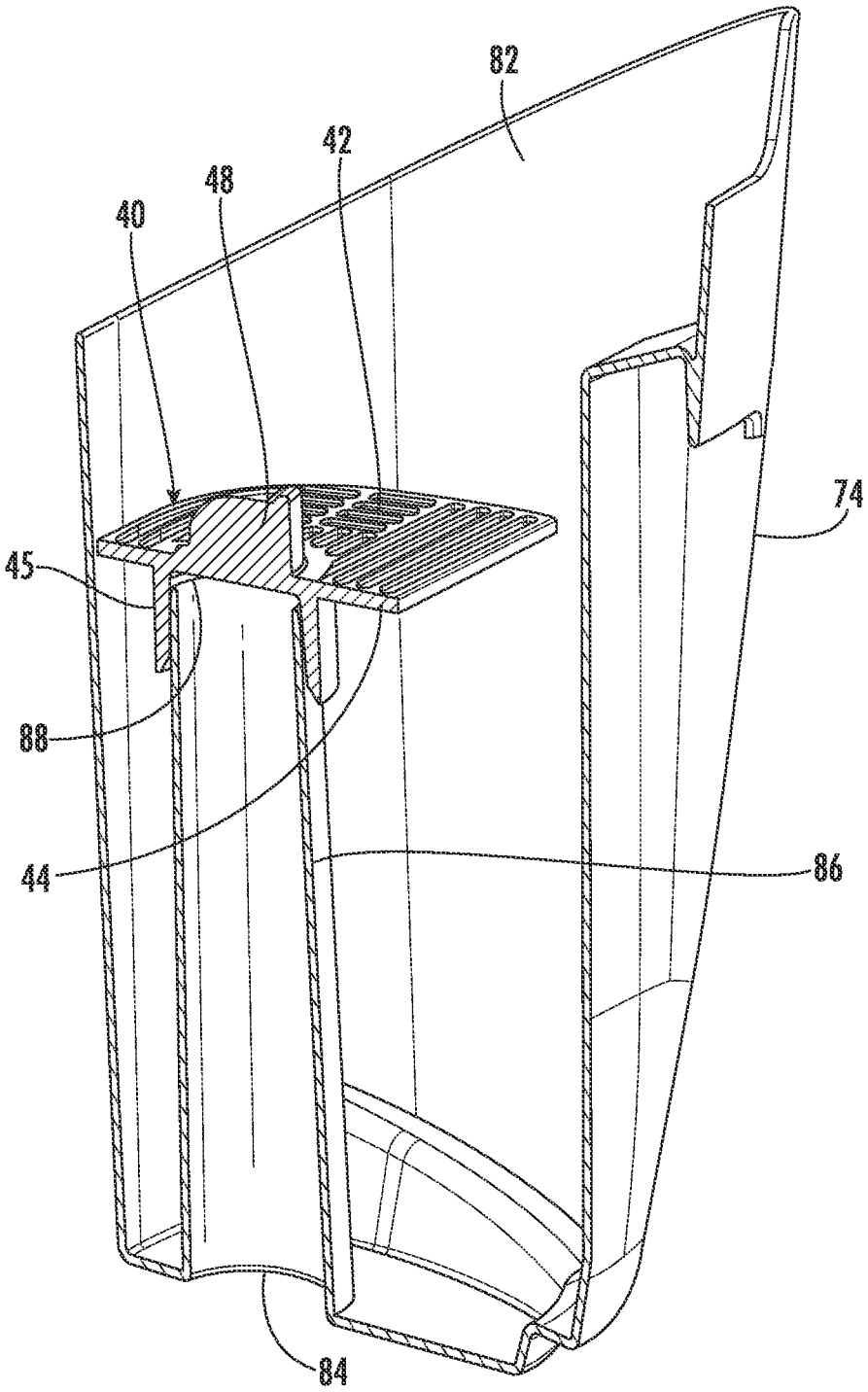
FIG. 6 is cross-sectional view of the recovery tank of FIG. 5 with the strainer in a seated position.
Figure 7:
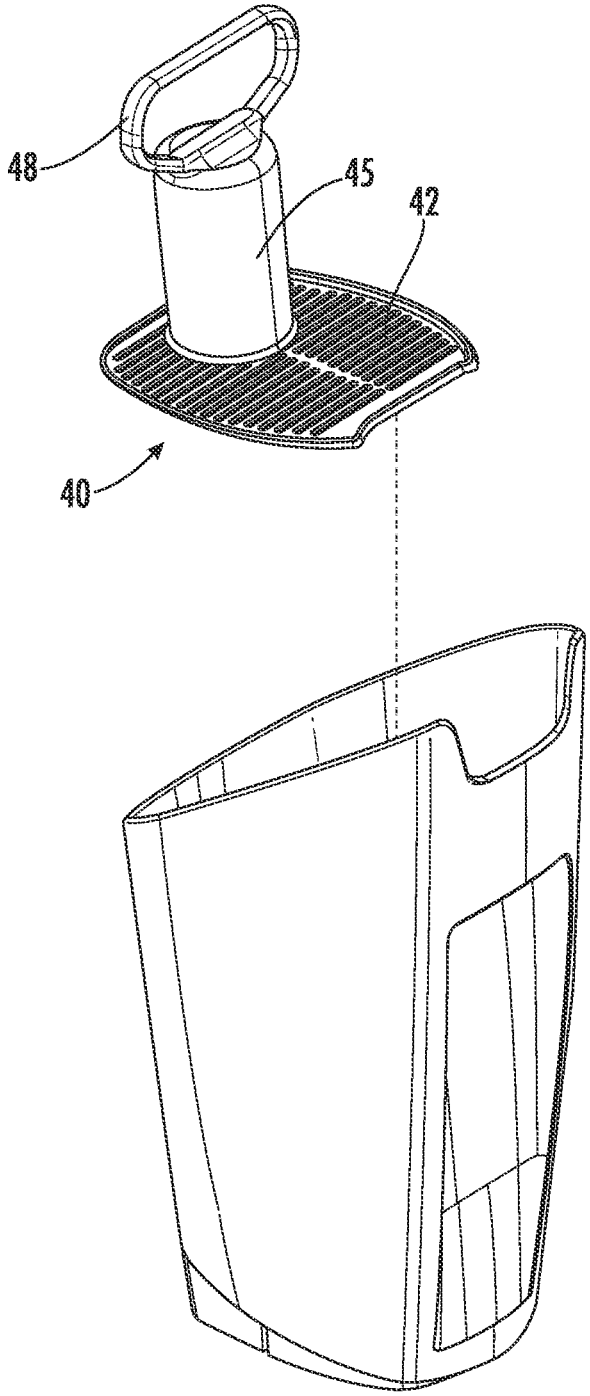
FIG. 7 is a perspective view of a recovery tank with an alternative strainer in a removed position.
Figure 8:
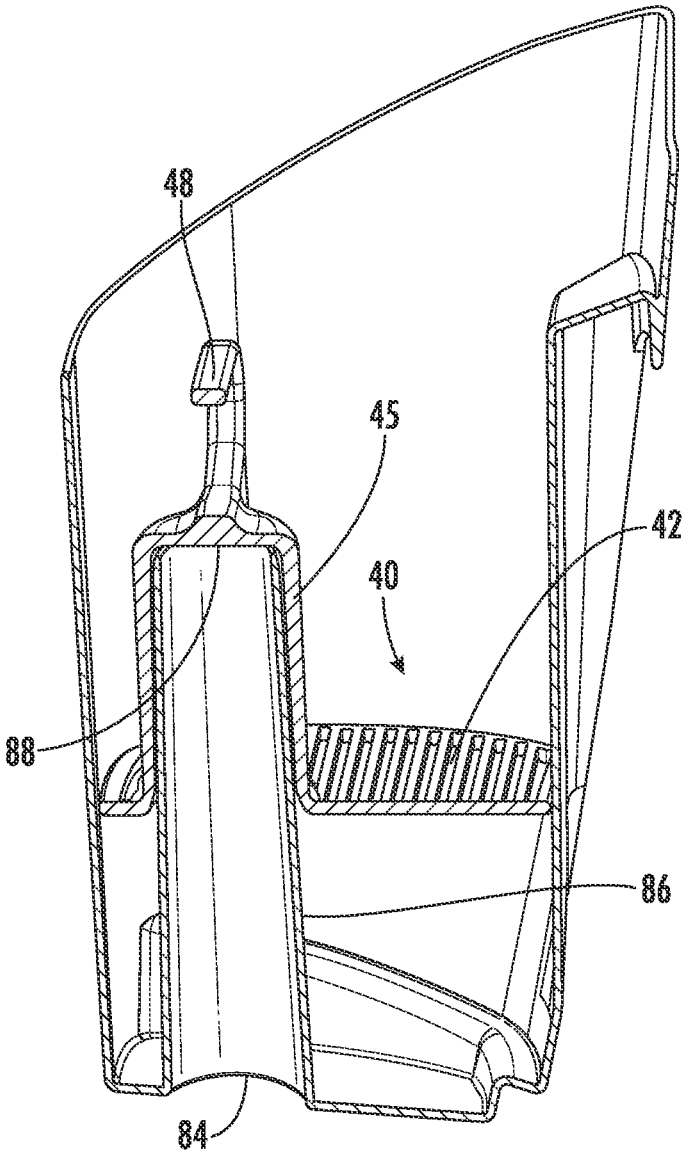
FIG. 8 is cross-sectional view of the recovery tank of FIG. 7 with the strainer in a seated position.

In the embodiments illustrated in FIGS. 3 and 4, the recovery tank 18 further includes a shutoff float 62. In operation, the shutoff float 62 moves between a lowermost position (illustrated in FIG. 4) and an uppermost position. Gravity maintains the shutoff float 62 in the lowermost position when the fluid level within the recovery tank is below a predetermined minimum fluid level. When the shutoff float 62 is in/or near the lowermost position, air can exit the recovery tank 18 through the suction air outlet 50. As fluid enters the recovery tank 18 through the inlet aperture 84 of inlet duct 86, the fluid level within the recovery tank 18 rises, causing the buoyant shutoff float 62 to raise towards the uppermost position. The shutoff float 62 is configured to be in the uppermost position when the fluid level in the recovery tank reaches a predetermined maximum fluid level. When the shutoff float 62 is in the uppermost position, the shutoff float 62 obstructs and closes the suction air outlet 50.

Various features and advantages of the invention are set forth in the following claims.

What is claimed is:

1. A floor cleaner comprising:

a vacuum source;

a supply tank configured to store a cleaning fluid;

a distribution nozzle in fluid communication with the supply tank, the distribution nozzle configured to dispense the cleaning fluid onto a surface to be cleaned;

a suction inlet in fluid communication with the vacuum source; and a recovery tank in fluid communication with the vacuum source and the suction inlet, the recovery tank configured to store the cleaning fluid drawn through the suction inlet from the surface by the vacuum source, the recovery tank including, a tank body having a lower end wall, an open upper end, and a sidewall that extends upwardly from the lower end wall to the open upper end; and a cover assembly removably coupled to the open upper end, configured to close the open upper end in a coupled position and uncover the open upper end in an uncoupled position;

a strainer positionable in the tank body in a seated position with the cover assembly in the uncoupled position, the strainer including a perforated body;

wherein the cover assembly is coupleable to the open upper end when the strainer is removed from the tank body and the cover assembly is not coupleable to the open upper end when the strainer is positioned inside the tank body, and wherein the perforated body of the strainer is disposed adjacent the sidewall when the strainer is in the seated position.

2. The floor cleaner of claim 1, wherein the recover tank includes an inlet duct in communication with the suction inlet, the inlet duct extending upwardly from the lower end wall, wherein the strainer is coupled to an upper portion of the inlet duct in the seated position.

3. The floor cleaner of claim 2, wherein the strainer is coupled to an outer portion of the inlet duct in friction engagement in the seated position.

4. The floor cleaner of claim 2, wherein the inlet duct is covered by the strainer when the strainer is in the seated position.

5. The floor cleaner of claim 1, wherein the strainer is releasably coupled to the recovery tank when the strainer is in the seated position.

6. The floor cleaner of claim 1, wherein the strainer interferes with the cover assembly when the strainer is in the seated position.

7. The floor cleaner of claim 1, wherein at least one of the strainer and the floor cleaner has a connecting member configured to connect the strainer to the floor cleaner for storage when the strainer is removed from the tank body.

8. The floor cleaner of claim 1, wherein the cover assembly includes a shutoff float.

9. A floor cleaner comprising:

a vacuum source;

a supply tank configured to store a cleaning fluid;

a distribution nozzle in fluid communication with the supply tank, the distribution nozzle configured to dispense the cleaning fluid onto a surface to be cleaned;

a suction inlet in fluid communication with the vacuum source;

a recovery tank in fluid communication with the vacuum source and the suction inlet, the recovery tank configured to store the cleaning fluid drawn through the suction inlet from the surface by the vacuum source, the recovery tank including, a tank body having a lower end wall, an open upper end, a sidewall that extends upwardly from the lower end wall to the open upper end, and an inlet duct that extends upwardly from the lower end wall; and a cover assembly removably coupled to the open upper end, configured to close the open upper end in a coupled position;

a strainer removably coupled to the inlet duct, the strainer including a perforated body, wherein the cover assembly can be coupled to the open upper end when the strainer is removed from the tank body, and the cover assembly cannot be coupled to the open upper end when the strainer is coupled to the tank body, and wherein the strainer is coupleable inside the tank body with the perforated body disposed adjacent the sidewall when the cover assembly is removed from the tank body.

10. The floor cleaner of claim 9, wherein the strainer is coupled to an outside portion of the inlet duct in friction engagement.

11. The floor cleaner of claim 9, wherein the strainer is coupled to an uppermost portion of the inlet duct.

12. The floor cleaner of claim 9, wherein the inlet duct is covered by the strainer when the strainer is coupled to the inlet duct.

13. The floor cleaner of claim 9, wherein at least one of the strainer and the floor cleaner has a connecting member configured to connect the strainer to the floor cleaner for storage of the strainer when the strainer is removed from the inside of the tank body.

14. The floor cleaner of claim 9, wherein the strainer interferes with the cover assembly when the strainer is coupled to the inlet duct.

15. The floor cleaner of claim 9, wherein the cover assembly includes a shutoff float.

* * * * *